US005192818A

United States Patent [19]

Martin

[11] Patent Number: 5,192,818

[45] Date of Patent: Mar. 9, 1993

[54] MEANS FOR REDUCING THE CRIMINAL USEFULNESS OF HAND WEAPONS

[76] Inventor: John M. Martin, 316 Roosevelt St., Lafayette, La. 70501

[21] Appl. No.: 553,555

[22] Filed: Jul. 18, 1990

Related U.S. Application Data

[63] Continuation-in-part of Ser. No. 188,646, May 2, 1988, abandoned, which is a continuation-in-part of Ser. No. 880,095, Jun. 30, 1986, abandoned, which is a continuation-in-part of Ser. No. 589,773, Mar. 15, 1984, abandoned.

[51] Int. Cl.[5] ..... F41A 17/08; F41A 17/30

[52] U.S. Cl. ..... 42/70.01; 42/84

[58] Field of Search ..... 42/70.01, 70.11, 84

[56] References Cited

U.S. PATENT DOCUMENTS

| | | | |
|---|---|---|---|
| D. 242,567 | 11/1976 | Cheng | D21/5 |
| 439,055 | 10/1890 | von Derschau | 42/84 |
| 3,106,238 | 10/1963 | Bruce | 431/91 X |
| 3,400,393 | 9/1968 | Ash | 42/84 |
| 3,685,194 | 8/1972 | Coon | 42/72 X |
| 3,704,536 | 12/1972 | Kratt | 42/70.01 |
| 4,003,152 | 1/1977 | Barker et al. | 42/70.11 |
| 4,122,620 | 10/1978 | Alexander | 42/70.11 |
| 4,154,014 | 5/1979 | Smith | 42/70.11 |
| 4,256,013 | 3/1981 | Quitadama | 42/84 |
| 4,457,091 | 7/1984 | Wallerstein | 42/70 R |
| 4,467,545 | 8/1984 | Shaw, Jr. | 42/1 LP |
| 4,488,370 | 12/1984 | Lemelson | 42/70.11 |
| 4,563,827 | 1/1986 | Heltzel | 42/70.11 |
| 4,658,702 | 4/1987 | Tatro | 42/69.03 X |
| 4,672,763 | 6/1987 | Cunningham | 42/70.01 |
| 4,682,435 | 7/1987 | Heltzel | 42/70.01 |
| 4,845,870 | 7/1989 | Vernon | 42/70.01 |

FOREIGN PATENT DOCUMENTS

| | | | |
|---|---|---|---|
| 2505604 | 8/1976 | Fed. Rep. of Germany | 42/70.11 |

OTHER PUBLICATIONS

Gross, B., "New Handgun For Self-Defense, But Not Crime", *Washington Post*, May 28, 1984.

*Primary Examiner*—David H. Brown

[57] ABSTRACT

An apparatus that limits the amount of time that a hand weapon can be discharged during use, an apparatus that limits the area of usefulness of a hand weapon, an apparatus for preventing the discharging of a hand weapon based on the weapon having been in an attitude that is good for concealed carrying, a method and an apparatus for preventing the discharging of a hand weapon that has had a part not necessary for the discharging of the weapon removed to increase concealability, an apparatus that transmits an identifying signal from a hand weapon under various conditions, a means necessary for the firing of a hand weapon that provides a detectable magnetic field in the vicinity of the hand weapon, an apparatus for preventing the discharging of a hand weapon based on a magnetic field that can be created in a location where the weapon is likely to be used for criminal purposes and an apparatus for preventing the discharging of a hand weapon based on a radio field that can be created in a location where the weapon is likely to be used for criminal purposes.

4 Claims, 7 Drawing Sheets

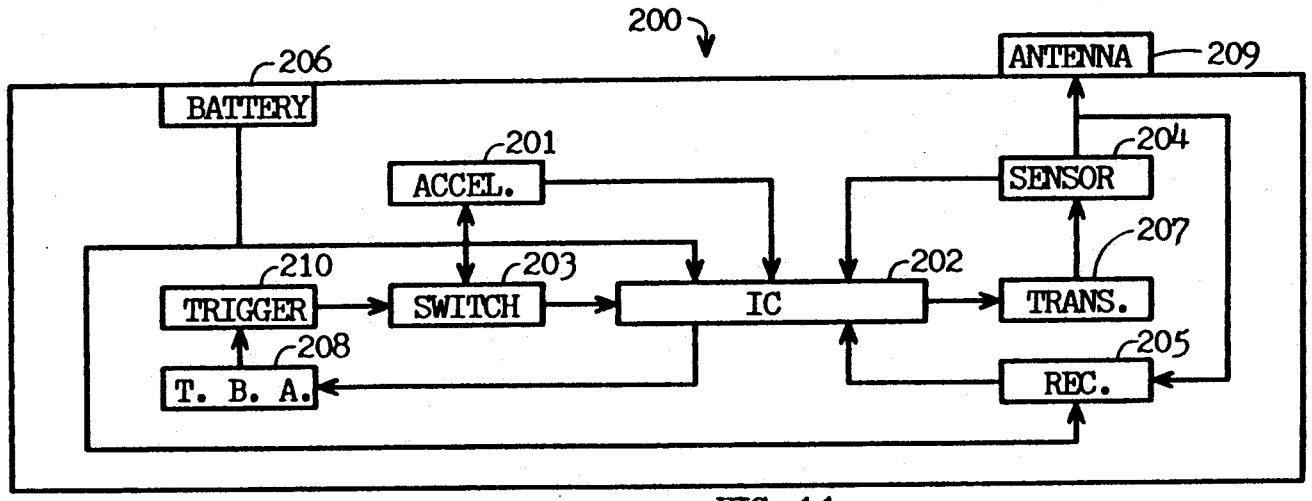
FIG. 11
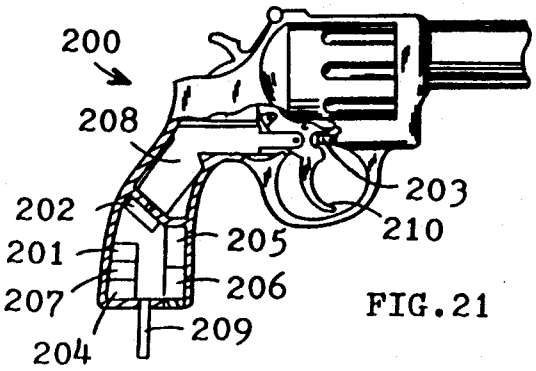
FIG. 12
FIG. 21
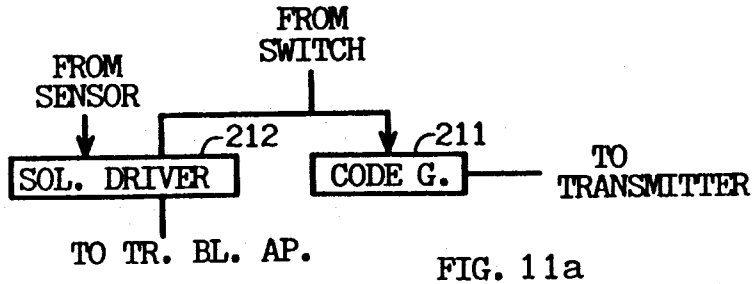
FIG. 11a

MEANS FOR REDUCING THE CRIMINAL USEFULNESS OF HAND WEAPONS

CROSS REFERENCE TO RELATED APPLICATIONS

This application is a continuation-in-part application of continuation-in-part application Ser. No. 188,646 filed May 2, 1988 and now abandoned which was a continuation-in-part application of application Ser. No. 880,095 filed Jun. 30, 1986 and now abandoned which was a continuation-in-part application of application Ser. No. 589,773 filed Mar. 15, 1984 and now abandoned.

BACKGROUND OF THE INVENTION

1. Field of the Invention

This invention relates to dischargeable hand weapons and in particular to methods and apparatuses for reducing the criminal usefulness of such weapons.

2. Description of Related Art

Dischargeable hand weapons are popular for defense of persons. Reducing the criminal usefulness of those weapons would save many lives and prevent much crime.

U.S. Pat. No. 3,400,393 discloses an apparatus having a means for receiving a directional electromagnetic signal and a means for preventing the discharging of a weapon based on the reception of the signal.

There is at least one safety device for preventing the discharging of a hand weapon it its angle of discharging is within a certain range.

SUMMARY OF THE INVENTION

There are several ways of reducing the usefulness of a hand weapon for crimes. One way is by limiting the amount of time that it may be discharged during use, thereby limiting its area of usefulness. Accordingly, one object of this invention is to provide a means for preventing the discharging a hand weapon in locations relatively distant from where the weapon is kept; more specifically, to provide an apparatus for limiting the amount of time that the weapon may be discharged during use (as determined by such things as a person approaching, touching, holding and moving the weapon).

Limiting the discharging of a hand weapon that has been carried concealed by a person will reduce the criminal usefulness of the weapon. Accordingly, another object of this invention is to provide an apparatus for preventing the discharging of a hand weapon based on the weapon having been in an attitude that is good for concealed carrying.

Preventing the discharging of a hand weapon that has had a part not necessary for the discharging of the weapon removed to increase concealability will reduce the criminal usefulness of the weapon. Accordingly, another object of this invention is to provide an apparatus for preventing the discharging of a hand weapon that has had a part not necessary for the discharging of the weapon removed to increase concealability.

Reducing the effectiveness of visual concealment of a hand weapon will reduce the criminal usefulness of the weapon. Accordingly, another object of this invention is to provide a means for disclosing the presence of a hand weapon concealed from view; more specifically, to provide an apparatus that transmits an identifying signal from a hand weapon under various conditions and to provide a means necessary for the firing of a hand weapon that provides a detectable magnetic field in the vicinity of the hand weapon.

Preventing the discharging of a hand weapon in business locations such as stores and banks will reduce the criminal usefulness of the weapon. Accordingly, another object of this invention is to provide an apparatus for preventing the discharging of a hand weapon based on conditions such as a signal or a magnetic field that can be created in a location where the weapon is likely to be used for criminal purposes.

Further objects and advantages of this invention will be apparent from a consideration of the drawings and descriptions herein.

BRIEF DESCRIPTION OF THE DRAWINGS

Drawings are not to scale and some obviously necessary parts may be omitted, e.g. ground wires, or modified in shape in order to allow for clearer illustration of other parts.

FIG. 11 is a block diagram of a handgun having electronic parts.

FIG. 11*a* illustrates an alternative to a part of the handgun of FIG. 11.

FIG. 12 further illustrates the handgun of FIG. 11.

DETAILED DESCRIPTION

In this application *hand weapon* means a weapon which discharges, has a civilian defensive use, is primarily designed for use against living things when used offensively or defensively and is designed to be either partly or totally and supported during use. Hand weapons include such things as handguns, rifles, shotguns, tear gas sprayers, electric shocking devices and small hand held rocket launchers such as the Gyro-Jet.

In this application *criminal usefulness of a hand weapon* refers to the usefulness of a hand weapon for illegal acts where one person willfully threatens or injures another person with the weapon.

Figure 1:
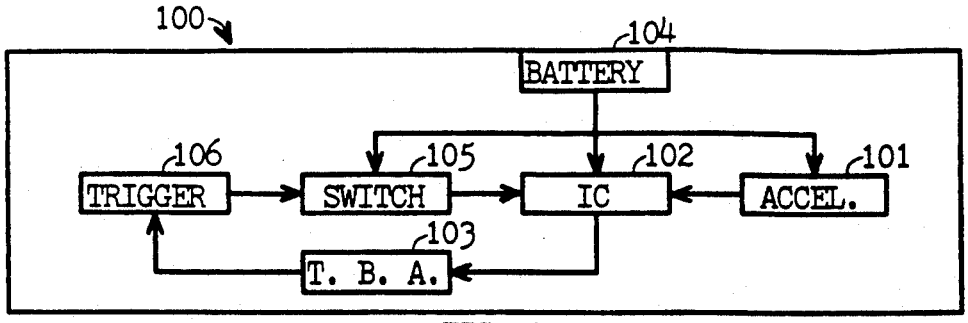
FIG. 1 is a block diagram of a handgun having electronic parts.
Figure 2:
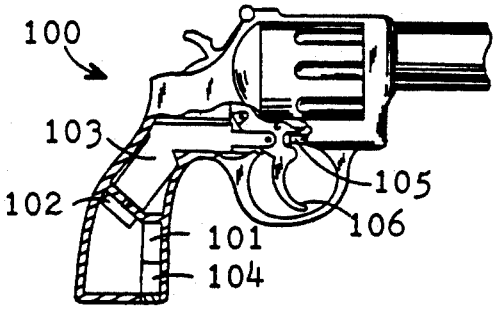
FIG. 2 further illustrates the handgun of FIG. 1.

FIGS. 1 and 2 illustrate a handgun 100 having an accelerometer 101 which functions as a means for detecting a condition necessary for using the handgun 100 for a use which involves the moving of the handgun 100. Normal use of a handgun necessarily involves the actions of approaching, touching and moving or changing of position of the handgun. In this case, the accelerometer 101 senses the accelerations that occur when the handgun is moved as it is picked up, carried, aimed, etc.

When the accelerometer 101 senses accelerations of the handgun 100, it sends that information to an IC 102 which has timing and other circuitry. This IC 102 as well as the other ICs of this application can be made by a custom IC manufacturer having the capability of making ICs based on functional descriptions such as those contained herein. *Electronic Engineer's Master Catalogue, Electronic Buyer's News Handbook and Directory, IC Master,* and *Electronic Buyer's Guide* are directories that contain listings of such manufacturers.

The IC 102 has an output that goes to a trigger blocking apparatus 103 which only permits firing when receiving power from the IC 102. A battery 104 constantly supplies power to the accelerometer 101, the IC 102 and a normally open switch 105 which is controlled by the handgun's trigger 106.

The triggers and trigger blocking apparatuses of this application are the same as parts 60 through 70 of U.S. Pat. No. 4,488,370, the switches are the same as part 17 of the same patent.

In this handgun 100 and in any other hand weapon described hereinafter having a trigger blocking apparatus, the trigger blocking apparatus 103 and the part of the trigger 106 in contact with the trigger blocking apparatus 103 are enclosed in a part of the weapon which has been welded shut or are enclosed in the weapon behind a lockable and unlockable part for accessing the apparatus 103. Welding serves as a means for preventing access to the trigger blocking apparatus 103 without causing damage to the weapon. Use of a lockable and unlockable part permits legal repairs and maintenance on the enclosed parts without damage to the weapon in a jurisdiction having a legal restriction on accessibility of the parts.

The handgun 100 is designed for defensive use in homes and businesses. Except for the electronic parts and the mechanical parts of the trigger blocking apparatus 103, it is essentially a revolver of conventional design.

Slightly pulling the trigger 106 for firing closes the switch 105. This sends power to a part of the IC 102 that allows the power to go to the trigger blocking apparatus 103 is there has been an at least 24 hour period during which there was no detecting of movement of the handgun 100 and it has been less than ten minutes since there was a detecting of movement ending the at least 24 hour period. This allows firing. If the time conditions have not been fulfilled, power will not be sent to the trigger blocking apparatus 103 and the apparatus 103 will prevent firing of the handgun 100.

In this handgun 100 and in any other handgun described hereinafter having a trigger blocking apparatus, the apparatus 103 prevents firing when not receiving power from the IC 102 by blocking complete trigger movement and allows firing when receiving power by not blocking any trigger movement. Thus, in this handgun 100 after the trigger blocking apparatus 103 begins receiving power, firing can be accomplished by a continuation of trigger pull. Because the handgun's electronic processing is very fast, firing of the handgun 100 can be made to feel no different than firing a conventional weapon.

Thus, in order for the handgun 100 to be fired, its accelerometer 101 must not sense an acceleration for an at least 24 hour period. After completing the minimum period, it can be fired during the 10 minute period immediately following the sensing of an acceleration, e.g. from movement that occurs when it is picked up for firing. After the 10 minute limit for firing is over, the handgun 100 can no longer be fired until it again fulfills the conditions required for firing. In addition, since all of its electronic parts depend on adequate battery power for operation, the handgun 100 cannot be fired unless it has had a good battery 104 in it for at least 24 hours.

Figure 1A:
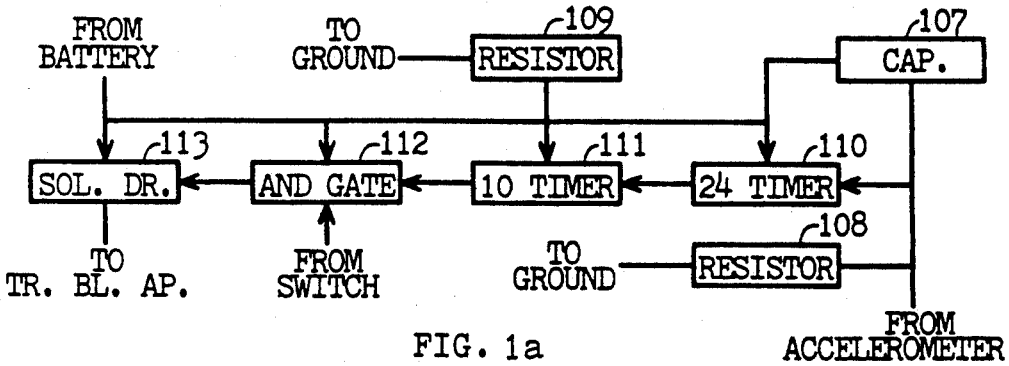
FIG. 1*a* illustrates an alternative to a part of the handgun of FIG. 1.

FIG. 1*a* illustrates a circuit that can be used as an alternative to the IC 102 of FIG. 1. It is based on an accelerometer having a logic 1 level output when it senses acceleration. It consists of a capacitor 107, two resistors 108 and 109, a 24 hour timer 110, a ten minute timer 111, a two input AND gate 112, and a solenoid driver 113, e.g. a transistor. The power inputs of the gate 112, the timers 110, 111 and driver 113 are all connected to the battery 104. The 24 hour timer's trigger is connected to the accelerometer 101 and to an RC network formed by the capacitor 107 and resistors 108, 109 which are grounded. The output of the 10 minutes timer 111 goes to one input of the AND gate 112 which has its other input connected to the switch 105. The output of the solenoid driver 113 is connected to the solenoid part of the trigger blocking apparatus 103. The 24 hour timer 110 can be an IC timer/counter capable of a 0 level output during timing, of being set to provide a 24 hour period, and of logic 1 level triggering and retriggering. The RC network has a capacitance which permits triggering by the battery 104 and resistances which allow for accelerometer triggering and retriggering and which discharge the capacitor 107 quickly enough for the timer to be triggered in the event that the battery 104 is connected, disconnected and then quickly reconnected. The 10 minute timer 111 can be an IC timer/counter capable of a 1 level output during timing, of being trigger and retriggered by a 1 level input and of being set to provide a 10 minute period. The 24 hour timer 110 is triggered by way of the RC network when the battery 104 is connected and retriggering by the battery 104 is prevented by the same network. Battery triggering prevents firing of the handgun 100 until the battery 104 has been connected for at least 24 hours. When the accelerometer 101 senses an acceleration, its 1 level output triggers or retriggers the 24 hour timer 110. This causes the timer's output to go to or stay at the 0 level for 24 hours. With no additional retriggering of the timer 110 for 24 hours, its output to the 10 minute timer 111 will go to the 1 level. This triggers and continues to retrigger the 10 minute timer 111 until the 24 hour timer 110 is again triggered when the handgun 100 undergoes movement, e.g. when it is picked up. During timing by the ten minute timer 111, the timer's output will remain at the 1 level. If the switch 105 is closed during that time there will be 1 levels on both of the AND gate's input and the gate 112 will then have a 1 level output which will turn on the solenoid driver 113. This energizes the solenoid part of the trigger blocking apparatus 103 which allows firing.

It is important that the handgun 100 has good resistance to tampering and circumvention. Such resistance is provided by welding shut the revolver part or providing it with a lockable and unlockable access part and by the use of a trigger blocking apparatus 103 that prevents firing if it does not receive power instead of one that prevents firing if it receives power which can be easily circumvented by removing the battery 104. In all of the other hand weapons described hereinafter having similar parts there is also the same resistance to tampering and circumvention offered to those parts.

In this application *based on,* when referring to discharging, refers to a basic condition for preventing discharging. A basic condition can be expressed in other ways which essentially mean the same thing, e.g., in the case of this handgun 100, it could be stated that firing is not prevented or is allowed or enabled for 10 minutes based on the handgun 100 having been moved after remaining motionless for at least 24 hours, etc. In addition, variations in the actual prevention of firing are within the scope of the basic condition for preventing discharging, e.g. The amount of time, if any, that firing is allowed after a certain event.

An accelerometer 101 is used with this handgun 100, however it is possible to use other sensors. For example, attitude sensors, and geomagnetic sensors can detect a change of position and proximity detectors can detect the approach and contact of a person with the handgun 100. If a proximity detector is used to detect approaching, the detection distance would be one that would not be approached within unless there was intent to touch the weapon, e.g. 2 cm.

It is also within the scope of this invention to use other conditions for preventing or limiting firing, e.g., if the detecting means detects more than 5 changes of position or 5 minutes of changes of position of the weapon during the immediately preceding 24 hour period.

Although it is possible to use other conditions, times, sensors, etc., those used are good choices. They reduce the portability of the handgun 100 for many crimes and make it useless for constant carrying as a concealed weapon, for most robberies and for getaways, hostage takings and shootouts lasting more than 10 minutes, while allowing it to be adequate for defense in homes and businesses.

Since the positions of most hand weapons used for defense in homes and businesses are not changed for long periods, the 24 hour requirement of this handgun 100 is not a great disadvantage for defensive use. And since most defense with hand weapons requires less than ten minutes and a person can have a backup weapon to use if more time is needed, there is no great disadvantage to the ten minute limit either.

FIGS. 3, 3*a*, 4 and 4*a* illustrate a handgun 120 having revolver part 121 and a stationary part 122.

The stationary part 122 has an accelerometer 123 that detects movement of itself and consequently the stationary part 122 by sensing accelerations that occur during movement of the part. The output of the accelerometer 123 goes to an IC 124. The output of the IC 124 goes to a transmitter 125 and the output of the transmitter 125 goes to an antenna 126. A battery 127 constantly supplies power to the IC 124. However, a jack 128 and wiring is provided to allow for the use of a battery eliminator so that power does not have to be supplied by the battery 123. This keeps operating costs low and makes it unnecessary to periodically supply fresh batteries.

Except for the battery 127, which is accessible for replacement, all the electronic parts of the stationary part 122 are embedded in opaque epoxy 129 which provides resistance to tampering.

The revolver part 121 has a radio receiver 130 which is connected to an antenna 131. The transmitter 125 and radio reciever 130 serve to link the stationary part 121 to the revolver part 121.

In this application, articles and apparatuses can be used for linking objects together. For example, a jack and a plug can rigidly link one object to another. Cords, cables and chains are examples of nonrigid articles that can nonrigidly link two objects together. This allows one of the objects to undergo a change of position while the other remains stationary. A transmitter and a receiver can also nonrigidly link two objects. This occurs when the receiver, in physical contact with one of the objects, is receiving a signal that is being transmitted by the transmitter which is in physical contact with the other object.

The revolver part 121 also has an IC 132. The IC 132 has an input from the receiver 130 and an output to a trigger blocking apparatus 133. A battery 134 supplies power to a normally open switch 135 which is controlled by the trigger 136. The output of the switch 135 goes to the IC 132 and the receiver 130.

The handgun 120 is designed for defensive use in homes and businesses with the stationary part 122 remaining stationary and the revolver part 121 carried and used within about 30 m of the stationary part 122. Except for the electronic parts and the mechanical parts of the trigger blocking apparatus 133, the revolver part 121 is essentially a revolver of conventional design.

The accelerometer 123 and the IC 124 are essential parts of a system for determining whether or not there has been movement of the stationary part 122 during the immediately preceding 24 hour period. When the accelerometer 123 senses an acceleration it sends that information to the IC 124 which has timing and other circuit. If stationary part 122 has not been moved during an immediately preceding 24 hour period, the IC 124 turns on the transmitter 125 which transmits by way of the antenna 126 a modulated signal with a frequency based on the serial number assigned to the handgun 120. If the stationary part 122 has been moved during the immediately preceding 24 hour period, it will not turn on the transmitter 125.

Slightly pulling the trigger 136 for firing closes the switch 135. This sends power to the revolver part's IC 132 and receiver 130. The receiver 130 has a sensitivity such that it cannot receive the signal transmitted by the transmitter 125 unless it is within about 30 m of the stationary part 122. Thus, being within about 30 m of the stationary part 122 when its transmitter 125 is transmitting is necessary for nonrigidly linking the revolver part 121 to the stationary part 122. If the receiver 130 receives the signal, it demodulates it and sends it to the IC. The transmitter 125 and receiver 130 serve to nonrigidly link the revolver part 121 to the stationary part 122. The receiving of the demodulated signal by the IC 132 causes it to determine that the revolver part 121 is linked to the stationary part 122 and to send power to the trigger blocking apparatus 133 which allows firing.

If the receiver 130 does not receive the signal, no power is sent to the trigger blocking apparatus 133 and the handgun 120 cannot be fired. Thus, in order for the handgun 120 to be fired, its accelerometer 123 must not have sensed a change of position for at least 24 hours and its revolver part 121 must be within about 30 m of its stationary part 122. In addition, since all the electronic parts of the handgun 120 depend on adequate battery power for operation, the handgun 120 cannot be fired unless it has had adequate battery power for at least 24 hours.

Figure 3:
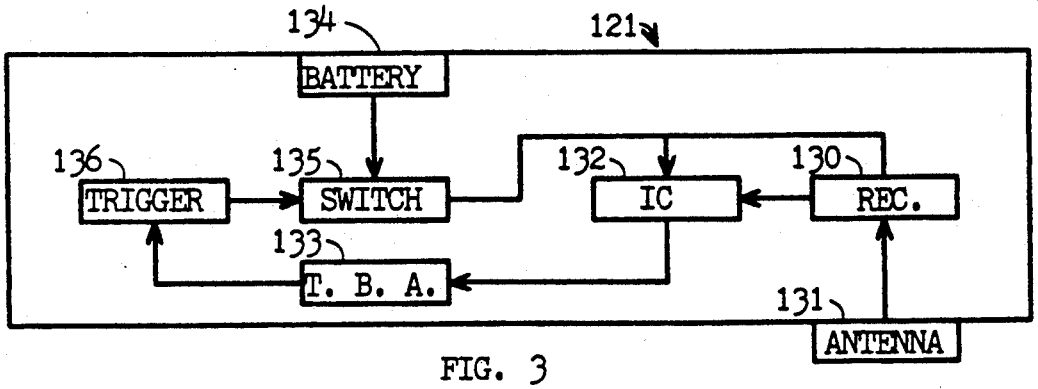
FIG. 3 is a block diagram of a handgun having electronic parts.
Figure 3A:
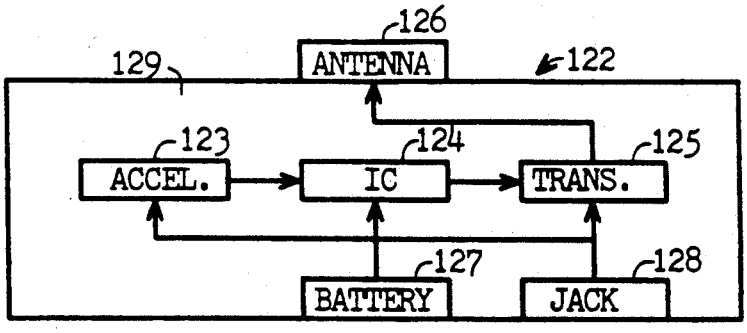
FIG. 3*a* is a block diagram of the rest of the handgun of FIG. 3.
Figure 3B:
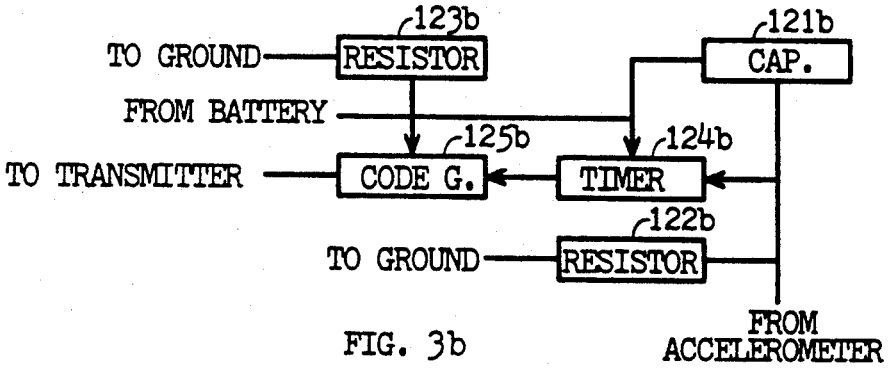
FIG. 3*b* illustrates an alternative to a part of the handgun of FIG. 3*a*.

FIG. 3*b* illustrates a circuit that can be used as an alternative to the IC 124 of FIG. 3*a*. It is based on an accelerometer having a logic 1 level output when it senses acceleration. It consists of a capacitor 121*b*, two resistors 122*b* and 123*b*, a 24 hour timer 124*b*, and a code generator 125*b*. The code generator 125*b* as well as any other code generator described hereinafter can be an IC such as an ICL8038. It is an oscillator that can be set to produce signals up to 300 k Hz.

The power inputs of the timer 124*b* and code generator 125*b* are connected to the battery 127. The trigger of the timer 124*b* is connected to the accelerometer 123 and to an RC network formed by the capacitor 121*b* and resistors 122*b*, 123*b* which are grounded. The output of the code generator 125*b* goes to the transmitter 125. The 24 hour timer 124*b* can be any IC timer/counter capable of a logic 0 level output during timing, of being set to provide a 24 hour period, and of being triggered and retriggered by a logic 1 level. The RC network has a capacitance which permits triggering by the battery 127 and resistances which allow for accelerometer triggering and retriggering and which discharge the capacitor 121*b* quickly enough for the timer 124*b* to be triggered in the event that the battery 127 is connected, disconnected and then quickly reconnected. The code generator 125*b* can be an IC oscillator capable of being turned on by a 1 level and of being set to a frequency based on the serial number of the handgun 120. The 24 hour timer 124*b* is triggered by way of the RC network when the battery 127 is connected and retriggering by the battery 127 is prevented by the same network. Battery triggering prevents firing of the handgun 120 until the battery 127 has been connected for at least 24 hours. When the accelerometer 123 senses an acceleration, its 1 level output triggers or retriggers the 24 hour timer 125*b*. This causes the timer's output to go to or stay at the 0 level for 24 hours. If there is no change of position of the stationary part 122 for 24 hours there will be no additional retriggering and the timer output will go to the 1 level. The 1 level turns on the code generator 125*b* which sends its output to the transmitter 125.

Figure 3C:
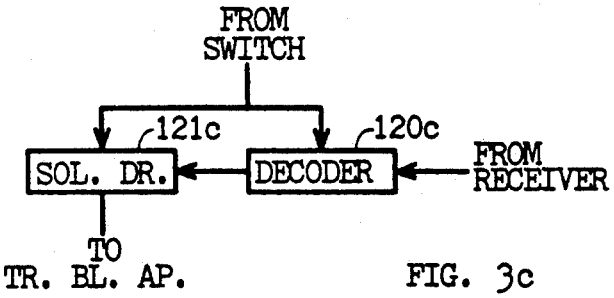
FIG. 3*c* illustrates an alternative to a part of the handgun of FIG. 3.
Figure 4:
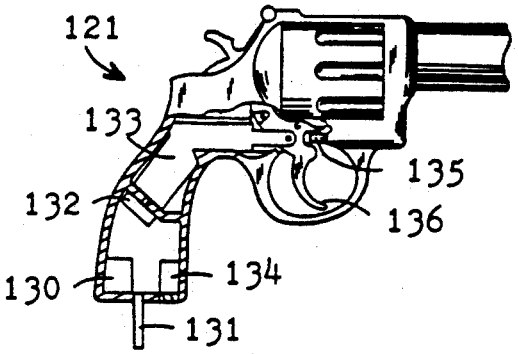
FIG. 4 further illustrates the parts of FIG. 3.
Figure 4A:
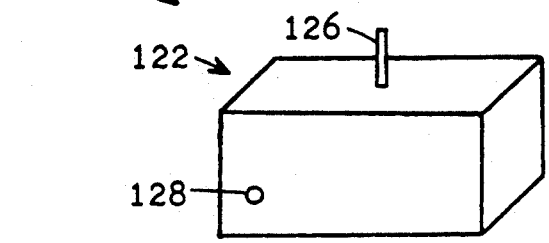
FIG. 4*a* further illustrates the parts of FIG. 3*a*.

FIG. 3*c* illustrates a circuit that can be used with the circuit of FIG. 3*b* as an alterative to the IC 132 of FIG. 3. It consists of a decoder 120*c*, and a solenoid driver 121*c*. The power input to the decoder 120*c* is connected to the switch 135 and its signal input is connected to the receiver 130. The power input to the solenoid driver 121*c* is connected to the switch 135 and its output connects to the solenoid part of the trigger blocking apparatus 133. The decoder 120*c* and any other decoder described hereinafter can bean IC decoder, (e.g., a 567 IC tone decoder can decode frequencies up to 500 kHz) capable of decoding the signal produced by the code generator 125*b* and of producing a logic level output suitable for turning on the solenoid driver 121*c* when it decodes that frequency. Decoding of the signal turns on the solenoid driver 121*c*. This energizes the solenoid part of the trigger blocking apparatus 133 which allows firing.

All of the electronic parts of the handgun 120 and the mechanical parts of the trigger blocking apparatus 133 can be regarded as an apparatus for reducing the criminal usefulness of a hand weapon (in this case, the handgun formed by the remaining parts of the handgun 120) comprising apart nonrigidly linked to the weapon and an automatic means for preventing the discharging of the weapon based on a movement of the part.

Many variations of this handgun 120 are possible, e.g. The signals could be sound or some other electromagnetic frequency, nonrigid linking could be by means of an electric cable, the linking means could be made to operate after 10 hours instead of 24, the receiver 130 could receive signals at 40 m, movement could, in effect, be sensed by a system having a detector that detects whether or not the stationary part 122 has been connected to a 120 volt ac outlet for a certain length of time, etc.

Figure 5:
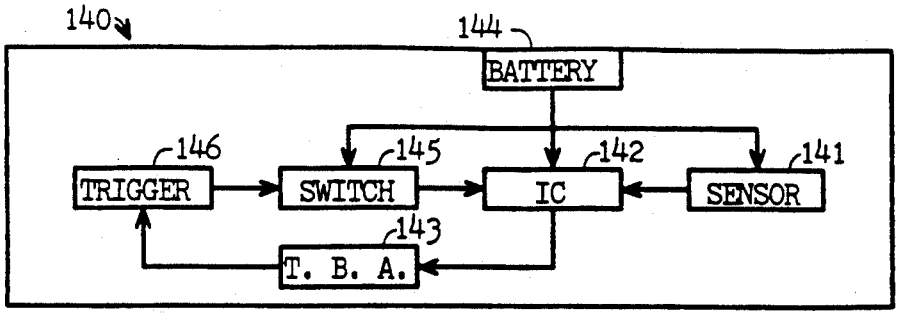
FIG. 5 is a block diagram of a handgun having electronic parts.
Figure 6:
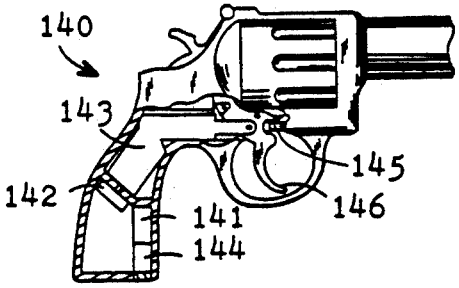
FIG. 6 further illustrates the handgun of FIG. 5.

Although other variations are possible, the parts and requirements used with this handgun 120 are good choices. They make the handgun 120 useless for many crimes. However, the handgun's usability inside of a relatively small area is not greatly different than that of a conventional handgun. The 30 m of relatively good portability makes it adequate for defense in homes and businesses. Since most hand weapons used for defense in homes and businesses remain in the same location for long periods until they are needed, the 24 hour requirement of this handgun 120 is not a great disadvantage for the average user, FIGS. 5 and 6 illustrate a handgun 140 having an attitude sensor 141 that senses a concealment attitude of the handgun 140, i.e. when the angle formed by the handgun's width dimension and the horizon is within the range of between 0 and 45 degrees.

A typical hand weapon is best concealed on a person if the angle formed by the handgun's width dimension and the horizon is about zero degrees. The further that the angle is from about zero degrees, the more unsuitable the weapon becomes for concealed carrying.

When the attitude sensor 141 senses a concealment attitude of the handgun 140, it sends that information to an IC 142 which has timing and other circuitry. The IC 142 has an output that goes to a trigger blocking apparatus 143 which only permits firing when receiving power from the IC 142. A battery 144 constantly supplies power to the attitude sensor 141, the IC 142 and a normally open switch 145 which is controlled by the handgun's trigger 146.

The handgun 140 is designed for defensive use in homes, businesses and vehicles. Except for the electronic parts and the mechanical parts of the trigger blocking apparatus 143, it is essentially a revolver of conventional design.

The attitude sensor 141 and IC 142 are essential parts of a system for determining whether or not the handgun 140 was at a concealment attitude during the immediately preceding 24 hour period and during the immediately preceding ten minute period.

Slightly pulling the trigger 146 for firing closes the switch 145. This sends power to a part of the IC 142 that allows the power to go to the trigger blocking apparatus 143 if there has been an at least 24 hour period during which the attitude sensor 141 did not sense that the handgun 140 was at a concealment attitude and its has been less than ten minutes since the attitude sensed a concealment attitude ending the at least 24 hour period. This allows firing of the handgun 140. If the firing conditions have not been met, power will not be sent to the trigger blocking apparatus 143 and the apparatus 143 will prevent firing of the handgun 140.

Thus, in order for the handgun 140 to be fired, its attitude sensor 141 must not sense the handgun 140 being at a concealment attitude for an at least 24 hour period. After completing the minimum period, the handgun 140 can be fired for an unlimited amount of time as long as the angle does not go between 0 and 45 degrees. If this should happen, the handgun 140 will only be able to be fired during the immediately following 10 minute period. After the 10 minute limit for firing is over, the handgun 140 can no longer be fired until again fulfills the conditions required for firing. In addition, since all of its electronic parts depend on adequate battery power for operation, the handgun 140 cannot be fired unless it has had a good battery 144 in it for at least 24 hours.

Figure 5A:
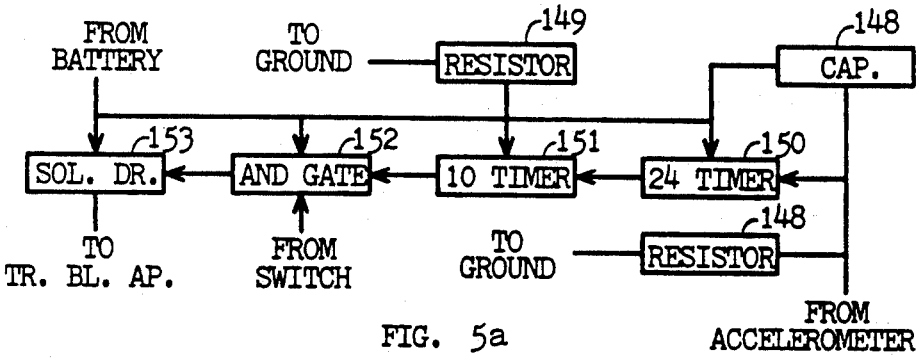
FIG. 5*a* illustrates an alternative to a part of the handgun of FIG. 5.

FIG. 5*a* illustrates a circuit that can be used as an alternative to the IC 142 of FIG. 5. It is based on an attitude sensor having a logic 1 level output when it senses a concealment attitude. It consists of a capacitor 147, two resistors 148 and 149, a 24 hour timer 150, a ten minute timer 151, a two input AND gate 152, and a solenoid driver 153. The power inputs of the gate 152, the timers and driver 153 are all connected to the battery 144. The 24 hour timer's trigger is connected to the attitude sensor 141 and to an RC network formed by the capacitor 147 and resistors 148, 149 which are grounded. The output of the 10 minute timer 151 goes to one input of the two input AND gate 152 which has its other input connected to the switch 145. The output of the solenoid driver 153 goes to the solenoid part of the trigger blocking apparatus 143. The 24 hours timer 150 can be an IC timer/counter capable of a 0 level output during timing, of being set to provide a 24 hour period, and of logic 1 level triggering and retriggering. The RC network has a capacitance which permits triggering by the battery 144 and resistances which discharges the capacitor 147 quickly enough for the timer to be triggered in the event that the battery 144 is connected, disconnected and then quickly reconnected. The 10 minute timer 151 can be an IC timer/counter capable of a 1 level output during timing, of being triggered and retriggered by a 1 level input and of being set to provide a 10 minute period. The 24 hour timer 150 is triggered by way of the RC network when the battery 144 is connected and retriggering by the battery 144 is prevented by the same network. Battery triggering prevents firing of the handgun 140 until the battery 144 has been connected for at least 24 hours. When the attitude sensor 141 sensors a concealment attitude, its 1 level output triggers or retriggers the 24 hour timer 150. This cases the timer's output to go to or stay at the 0 level for 24 hours. If there is no additional retriggering of the timer for 24 hours its output to the 10 minute timer will go to the 1 level. This triggers the 10 minute timer 151 and continues to retrigger it as long as the handgun 140 is not placed in a concealment attitude. During timing by the ten minute timer 151, its output will remain at the 1 level. If the switch 154 is closed during that time there will be 1 levels on both of the AND gate's inputs and the gate 152 will then have a 1 level output. This will turn on the solenoid driver 153 which will energize the solenoid part of the trigger blocking apparatus 143 to allow firing.

The electronic parts of this handgun 140 together with the mechanical parts of the trigger blocking apparatus 143 can be regarded as an apparatus for reducing the criminal usefulness of a hand weapon (in this case the weapon formed by the remaining parts of the handgun 140) comprising a means for sensing a certain attitude of the weapon and means for preventing the discharging of the weapon based on the sensing means sensing the attitude during a past certain period.

Although it is possible to use other conditions for preventing the firing of this handgun 140 (e.g. The angle may be formed by the weapon's length dimension and the horizon, with the range being between 50 and 90 degrees and with discharging being prevented if there has been more than 10 minutes of sensing the angle being within that range during the immediately preceding 24 hour period), etc., those used as good choices. They make it a poor choice for constant illegal carrying as a concealed weapon, and for many other crimes while allowing the handgun 140 to be adequate for defense in homes, businesses and vehicles.

Since most hand weapons used for defense in homes, businesses and vehicles lie on their sides for long periods until they are needed, the 24 hour requirement of this handgun 140 is not a great disadvantage for the average user. And since most defense with hand weapons requires less than ten minutes of use and unlimited firing time can be obtained by not putting the handgun 140 at an angle that can be sensed during use, there are no great disadvantages to the ten minute limit either.

Figure 7:
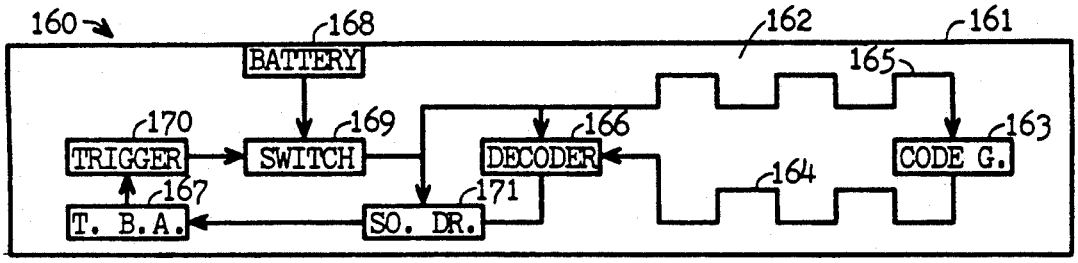
FIG. 7 is a block diagram of a shotgun having electronic parts.
Figure 8:
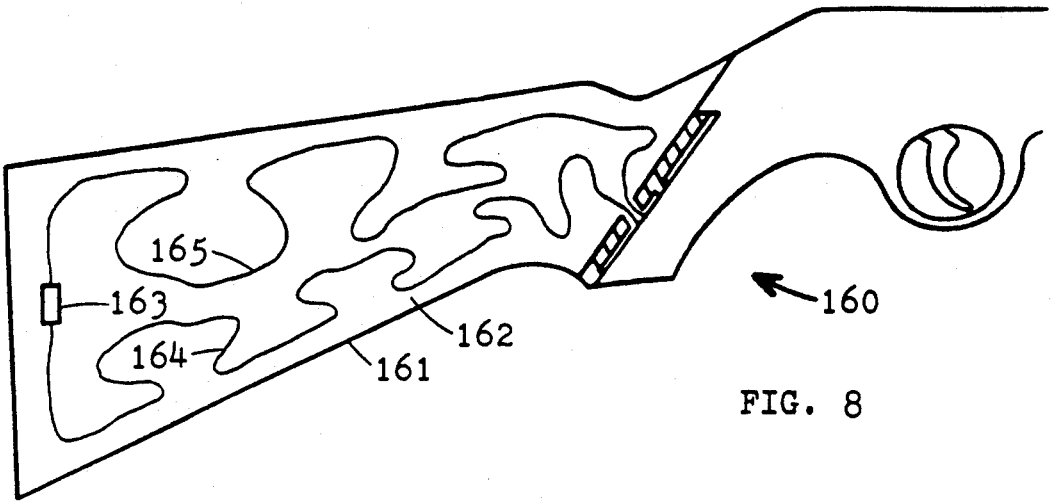
FIG. 8 further illustrates the shotgun of FIG. 7.

FIGS. 7 and 8 illustrate a shotgun 160 having a buttstock 161 of opaque epoxy 162 with a code generator 163, a 30 gage (AWG) thinly insulated signal wire 164, a power wire 165 and a ground wire (not illustrated) all 1 m long and winding without access through the epoxy 162. This construction makes it almost impossible to significantly reduce to size of the buttstock 161 or to tamper with the electronic parts embedded in its without damaging one or more of the parts.

The code generator 163, signal wire 164 and a decoder 166 are essential parts of a system for determining whether or not the buttstock 161 is intact and joined to the rest of the shotgun 160. The decoder 166 can be an IC decoder capable of decoding the signal generated by the code generator 163 and of turning on a solenoid driver 171 when it decodes that signal.

The output of the decoder 166 IC goes to the solenoid driver 171. The driver 171 is capable of driving the solenoid part of the trigger blocking apparatus 167 which prevents firing of the shotgun 160 when it is not being driven. A battery 168 is connected to a normally off switch 169 which is controlled by the trigger 170.

The buttstock 161 was formed by injecting freshly mixed opaque epoxy into a mold holding all the illustrated parts. Except for the electronic parts and the mechanical parts of the trigger blocking apparatus 167, the shotgun 160 is essentially a shotgun of conventional design.

Slightly pulling the trigger 170 for firing closes the switch 169. This sends power from the battery 168 through the power wire 165 to the decoder 166, to the solenoid driver 171 and to the code generator 163. The power causes the code generator 163 to generate a signal having a frequency based on a serial number assigned to the shotgun 160. The signal is coupled to the decoder 166 through the signal wire 164. The decoder 166 decodes the signal which turns on the solenoid driver 171. This causes the driver 171 to send driving power to the solenoid part of the trigger blocking apparatus 167 which then allows firing.

If the buttstock 161 is cut down or completely removed, no signal will received by the decoder 166. Consequently, it will not turn on the solenoid driver 171 to send power to the trigger blocking apparatus 167. With no power going to the trigger block apparatus 167, the apparatus 167 will block complete trigger movement and the shotgun 160 will not be able to be fired. Also, since no signal will be received by the decoder 166 if one of the electronic parts in the buttstock 161 has been damaged the shotgun 160 will not be able to be fired under that condition either.

It is important the shotgun 160 has good resistance to tampering and circumvention. Such resistance is provided by welding shut the past housing the trigger blocking apparatus 167 or providing it with a lockable and unlockable access part, by the small diameter of the wires which makes them easy to cut or break and difficult to splice, by embedding and winding the wires in the epoxy 162 which makes it difficult to cut into the epoxy 162 without cutting at least one wire, by the use of a code system instead of a fairly nonspecific direct current which is easily obtained with batteries and by the use of a trigger blocking apparatus 167 that prevents firing if its does not receive power instead of one that prevents firing if it receives power which can be easily circumvented by removing the battery. In all of the other hand weapons described hereinafter having similar parts there is also the same resistance to tampering and circumvention offered by those parts.

All of the electronic parts of the shotgun 160 and the mechanical parts of the trigger blocking apparatus 167 can be regarded as an apparatus for reducing the criminal usefulness of a hand weapon (in this case the shotgun formed by the remaining parts of the shotgun 160) comprising a means for determining whether or not a part of the weapon not necessary for the discharging of the weapon has been disjoined from the weapon and a means for preventing the discharging of the weapon based on the part being disjoined from the weapon.

The electronics of this shot gun 160 deter the cutting down of the buttstock 161 to increase the concealability and/or portability of the shotgun 160 and the principle that is employed can be used to deter cutting down of other parts of this and other hand weapons. It is also possible to use other parts and systems to achieve the same purpose, e.g., a fiber optic system could be used instead of the signal wire 164 and associated system.

Figure 9:
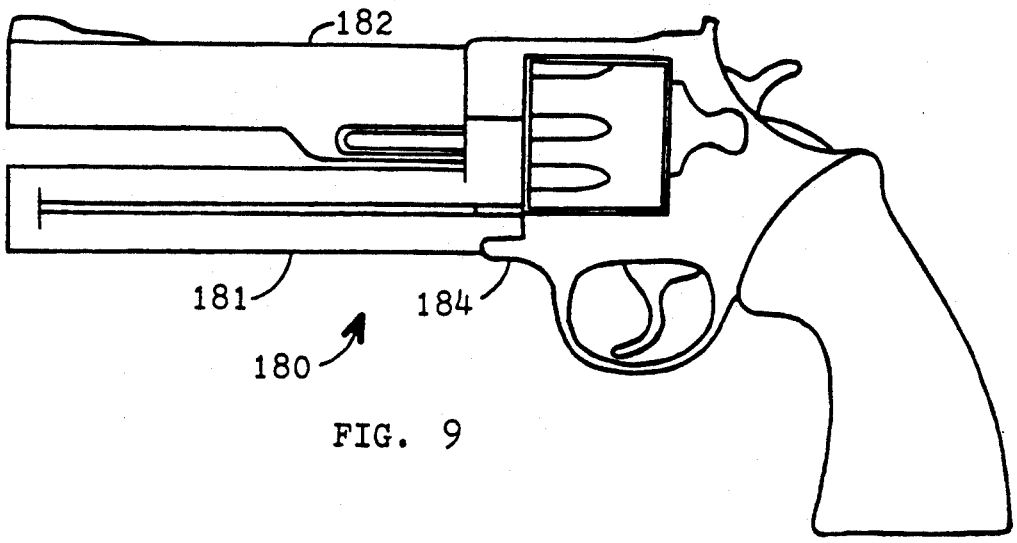
FIG. 9 illustrates a handgun having a forward projecting crane.

FIG. 9 illustrates a revolver 180 that is identical to a 0.22 caliber Colt Trooper MK III having a 15.24 cm barrel 182 except that it has a permanently magnetized Alnico XII (number 12) crane 181. The operation of the revolver 180 is the same as that of the Trooper.

The crane 181 extends forward 15.24 cm from the beginning of the barrel 182 which means the crane 181 extends forward for the length of the barrel 182.

Figure 10:
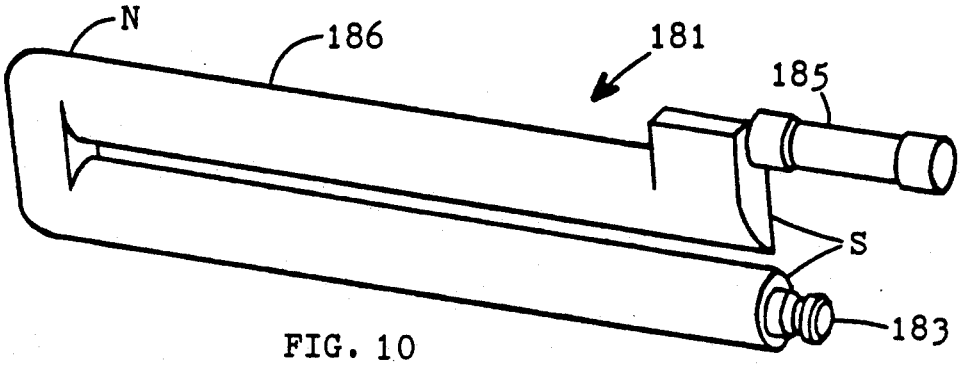
FIG. 10 further illustrates the crane of FIG. 9.

FIG. 10 illustrates that the crane 181 has a pivoting part 183 for joining the crane 181 to the frame 184, a cylinder supporting part 185 and a forward extending linking part 186. Like a Trooper crane, the illustrated crane 181, including the linking part 186, is necessary for the firing of the revolver 180, i.e., it holds the cylinder in place.

A Trooper having a 15.24 cm barrel is not easily concealed in light clothing. Its barrel, however, can be easily cut down to 5 cm to give the revolver 180 good concealability. On the other hand, with the illustrated revolver 180 there would be little to gain by cutting down its barrel 182 to 5 cm. Its crane 181 would still extend forward. This gives it reduced criminal usefulness compared to a Trooper. In addition, Alnico XII as well as the other Alnico alloys are hard and except for grinding, cannot be machined. Thus, it would be difficult to shorten the crane 181 and still have it operate properly.

N and S indicate magnetic polarity and that the polarity of the Alnico material is in the length dimension of the crane 181. The material provides a magnetic field in the vicinity of the revolver 180 that can be sensed by magnetic sensing devices. Such devices could be located in stores, banks, airline terminals, government offices, etc. to disclose the presence of a magnetized hand weapon concealed on a person or in baggage.

Although it is within the scope of this invention to use different materials, dimensions or shapes for the crane 181, the ones used as good choices. They reduce criminal usefulness of the revolver 180 but do not greatly affect its use or handling when it is used for most defensive purposes.

It is also possible to use the crane 181 on a Trooper having a longer barrel to deter cutting its barrel to less than 15.24 cm or with shorter barreled Trooper to decrease the concealability of the revolver 180.

Because the revolver 180 has reduced criminal usefulness, it may find acceptance for home, business and vehicle defense in areas where conventional handguns are greatly restricted or banned. In addition, if a state or community should ban conventional revolvers in favor of revolvers having cranes that extend forward and/or revolvers having magnetized parts necessary for the firing of the revolvers, the illustrated crane 181 and similar cranes could be used to modify the conventional revolvers already there so that those revolvers would not have to be sold nor thrown away. Modification would consist of removing a conventional crane and replacing it with the illustrated crane 181 or a similar crane.

FIGS. 11 and 12 illustrate a handgun 200 having an accelerometer 201 that detects the action of the handgun 200 being moved by sensing accelerations that occur when the position of the handgun 200 is changed by such things as the picking up and carrying of the handgun 200.

The output of the accelerometer 201 goes to an IC 202. The IC 202 has give inputs; one from the accelerometer 201, one from a normally open switch 203, one from an SWR (standing wave ratio) sensor 204, one from a radio receiver 205 and one from a battery 206. The IC 202 has two outputs: one to the transmitter 207 and one to a trigger blocking apparatus 208. The transmitter 207 output goes to the SWR sensor 204 and then on to an antenna 209, which also connects with the receiver 205. The battery 206 constantly supplies power to the accelerometer 201, the IC 202, the receiver 205 and the switch 203.

The handgun 200 is designed for defensive use at any location. Except for its electronic parts and the mechanical parts of the trigger blocking apparatus 208, it is essentially a revolver of conventional design.

The switch 203 is controlled by the trigger 210 and slightly pulling the trigger 210 for firing closes the switch 203. This sends power to a part of the IC 202 that causes it to turn on the transmitter 207 to transmit a sine wave radio signal based on a serial number assigned to the handgun 200. Whenever the signal is transmitted, the SWR sensor 204 senses the standing wave ratio of the antenna 209 and wiring that the receiver 205 and transmitter 207 share. In cases where the antenna 209 or wiring has been out, the antenna 209 shielded or other transmitting parts tampered with, the SWR will be abnormal.

The SWR sensor 204 sends information about the SWR to the IC 202. If the SWR is normal, the IC 202 will send power to the trigger blocking apparatus 208 which allows firing. If the SWR is abnormal the IC 202 will not send power to the trigger blocking apparatus 208 for at least 24 hours and the handgun 200 will not be able to be fired during that time. This prevents a person from tapering with or shielding the antenna 209 to restrict the transmitting of the signal and/or reducing the receiving abilities of the handgun 200. Also, the IC 202 will not send any power to the trigger blocking apparatus 208 unless the battery 206 has been connected without interruption for at least 24 hours.

The IC 202 also turns on the transmitter 207 to transmit the signal under three other conditions: at random times on the average of once every hour, at random times on the average of once every five minutes during the first hour following the accelerometer 201 sensing a change of position of the handgun 200 and whenever the receiver 205 receives an interrogating signal.

An interrogating signal can be transmitted by an electronic system located in a store, bank, airport, high crime area or other place where it is desirable to prohibit unauthorized hand weapons having the receiving and transmitting abilities of this handgun 200. Such a system would have a transmitter for transmitting an interrogating signal, a receiver for receiving a signal from the weapon and an alarm or other device to indicate that a weapon is in the vicinity. It could also have a device for recording the serial number of the weapon.

FIG. 11*a* illustrates a circuit that can be used as an alternative to the IC 202 of FIG. 11 if only transmitting when firing is desired. It is based on a SWR sensor having an output capable of turning on a solenoid driver when it senses a normal SWR. It consists of a code generator 211 and a solenoid driver 212. The code generator 211 is connected to the switch 203 and its output goes to the transmitter 207. The solenoid driver 212 has its power input connected to the switch 203, its controlling input connected to the output of the SWR sensor 204 and its output connected to the solenoid part of the trigger blocking apparatus 208. The code generator 211 can be an IC capable of generating a signal having a frequency based on the serial number assigned to the handgun 200. Closing the switch 203 for firing turns on the code generator 211 and the transmitter 207 transmits the generator 211's signal by way of the SWR sensor 204. If the sensor 204 senses a normal SWR it turns on the solenoid driver 212 which energizes the solenoid part of the trigger blocking apparatus 208 to allow firing.

The electronic parts of this handgun 200 together with the mechanical parts of the trigger blocking apparatus 208 can be regarded as an apparatus for reducing the criminal usefulness of a hand weapon (in this case the weapon formed by the remaining parts of the handgun 200) comprising a means for transmitting a signal and a means for preventing the discharging of the weapon based on the transmitting means being restricted in the transmitting of the signal.

Although, it is possible to use other types of signals (e.g., infrared or sound waves), times, sensors (e.g., an attitude sensor), etc., those used are good choices. They make the handgun 200 useless for concealed carrying in the in a location having a system for receiving the signals from the handgun 200. The handgun 200 can also by detected when it is not being carried, however its ability to be detected is not a disadvantage for most defensive uses.

Figure 13:
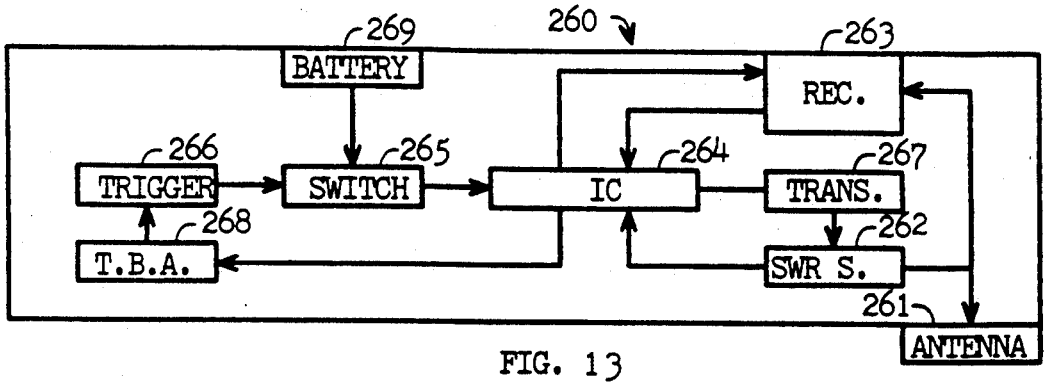
FIG. 13 is a block diagram of a handgun having electronic parts.
Figure 14:
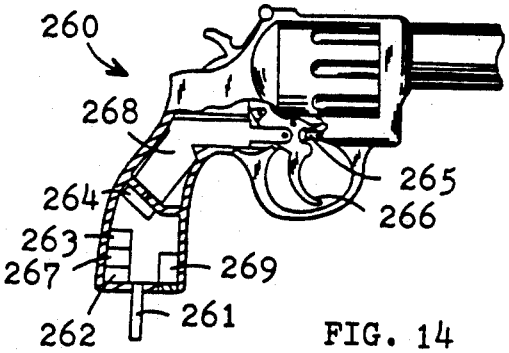
FIG. 14 further illustrates the handgun of FIG. 13.

FIGS. 13 and 14 illustrate a handgun 260 having an antenna 261 connected to an SWR (standing wave ratio) sensor 262 and a radio receiver 263. The output of the receiver 263 goes to an IC 264. The IC 264 has inputs from the receiver 263, the SWR sensor 262 and a normally open switch 265 which is controlled by the handgun's trigger 266. The IC 264 has three outputs: one to the receiver 263, one to a radio transmitter 267 and one to a trigger blocking apparatus 268. A battery 269 supplies power to the switch 265. Except for its electronic parts and the mechanical parts of the trigger blocking apparatus 268, the handgun 260 is essentially a revolver of conventional design.

Slightly pulling the trigger 266 for firing closes the switch 265. This supplies power to the IC 264 and causes it to turn on the receiver 263 for 0.5 milliseconds. The receiver 263 is made to receive unmodulated radio signals that must have a certain frequency and a signal strength of more than 0.01 watts per square meter.

During the 0.5 millisecond period, the receiver 263 sends an output to the IC 264 if any signal is received. After the period; the IC 264 turns on the transmitter 267 to transmit a signal modulated with a frequency based on a serial number assigned to the handgun 260. This signal goes through the SWR sensor 262 and is transmitted by the antenna 261.

The output of the SWR sensor 262 goes to the IC 264. The output reflects whether or not the receiver 263 is being restricted in the receiving of the signal. This is important for the handgun 260. The receiver 263 and the transmitter 267 share the same antenna 261 and also some other wiring. Attempts to circumvent the handgun's operation by shielding of tampering with the antenna 261 or wiring to restrict the receiving of the signal is sensed as an abnormal SWR by the SWR sensor 262 when the signal is transmitted. If, when the trigger 266 is pulled, the SWR is determined to be abnormal, the IC 264 will not send any power to the trigger blocking apparatus 268.

If a signal is not received by the receiver 263 and the value of the SWR is normal, the IC 264 will send power to the trigger blocking apparatus 268 which will allow the handgun 260 to be fired.

If, when the trigger 266 is pulled, a signal is received by the receiver 263 and the SWR is normal, the IC 264 will turn on the receiver 263 again for 0.5 milliseconds immediately after it has sent the code signal. If, during the 0.5 milliseconds, the receiver 263 receives an uninterrupted signal, the IC 264 will not send any power to the trigger blocking apparatus 268. On the other hand, if the signal is interrupted for 0.1 millisecond during the 0.5 millisecond period, the IC 264 will send power to the trigger blocking apparatus 268 which will allow the handgun 260 to be fired.

Figure 15:
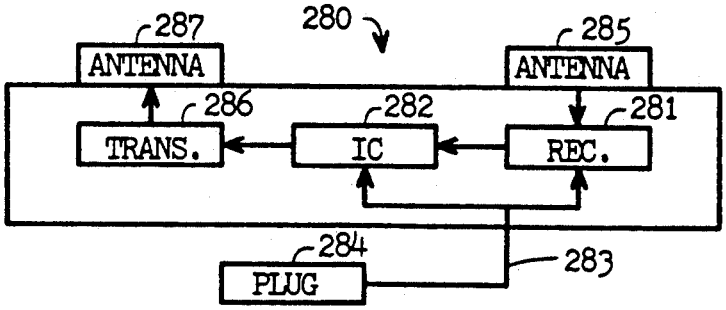
FIG. 15 is a block diagram of an apparatus for preventing the firing of handguns similar to the handgun of FIGS. 13 and 14.
Figure 16:
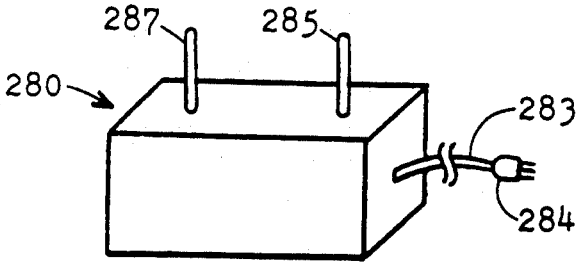
FIG. 16 a further illustrates the apparatus of FIG. 15.

Interrupted and uninterrutped signals can be transmitted from antifiring system 280 such as the one illustrated by FIGS. 15 and 16. This particular system 280 can prevent or allow the discharging of weapons having electronic parts similar to those of the illustrated handgun 260. The ability of this and similar systems to prevent firing makes it possible to place such systems in locations susceptible to robberies so that this handgun 260 would be useless for robberies at those locations. This would only affect its operation at such locations and it could be used at all other locations without any limitations.

Power is supplied to a receiver 281 and an IC 282 by means of an electric cord 283 and a plug 284 that plugs into a suitable source of power. The receiver 281 has an antenna 285 and the receiver's output goes to the IC 282. The IC 282 controls the power going to a transmitter 286 which has its own antenna 287. The transmitter 286 continuously transmits a signal that a weapon's receiver is capable of receiving if the antifiring system 280 is within about 20 m of the weapon. This is because the signal strength of the signal is less than 0.01 watts at distances greater than about 20 m from the transmitter 286.

The handgun 260 can be used in any location not protected by an antifiring system that is not matched to the handgun 260. The illustrated antifiring system 280 will not prevent the firing of the illustrated handgun 260 at any time because it is matched with the handgun 260. The antifiring system 280 can be used in conjunction with the illustrated handgun 260 to prevent the discharging of susceptible weapons carried by criminals without affecting the firing of the illustrated handgun 260. When the system's receiver 281 receives the signal of the handgun's serial number that is transmitted by the handgun's transmitter 267 it decodes the signal and sends the information to the system's IC 282. The IC 282 is programmed to respond to the serial number by turning off the transmitter 286 for 0.1 millisecond. It is this interrupted signal that causes the handgun's IC 264 to send power to the trigger blocking apparatus 268. In the case of weapons not matched with the antifiring system 280, the system's IC 282 will not interrupt the signal and the consequently the weapon will not be able to be fired as long as it is within about 20 m of the system 280.

The frequencies used by the handgun 260 and systems 280 are critical only in that the system's receiver 281 has a very narrow bandwidth and it and the handgun's transmitter 267 operate at a frequency 1 kilohertz away from the handgun's receiver 263 and the system's transmitter 286. This assures better reception of the code signal since the system's transmitter 286 is much stronger than the handgun's transmitter 267.

The 0.01 watts per square meter signal strength requirement was chosen to make it difficult for a criminal to carry around an antifiring system to prevent being fired at. The capability of transmitting a signal of that strength at practical distances requires an antifiring system of a size and weight that is unsuitable for concealed carrying. However, size and weight are not very important for a fixed location such as a place of business or for carrying unconcealed to a location such as a shootout.

Figure 13A:
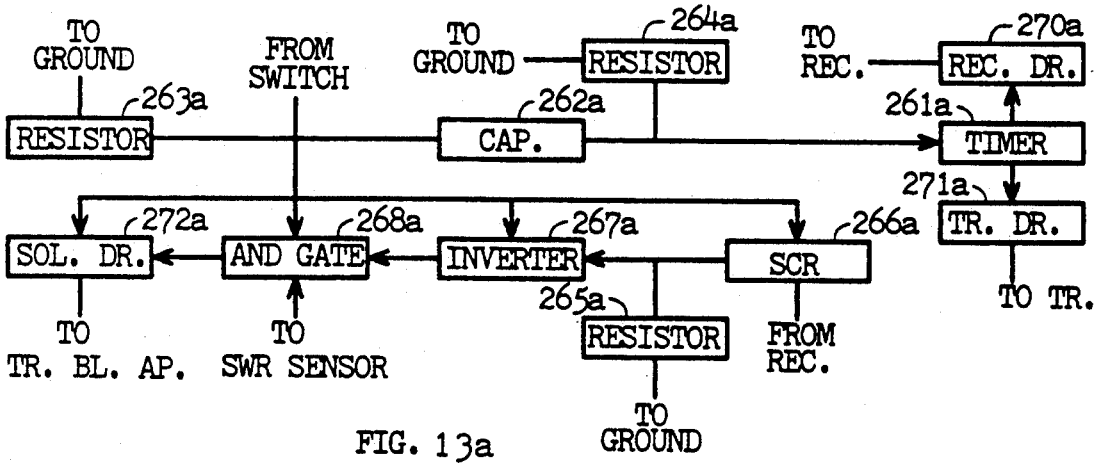
FIG. 13*a* illustrates an alternative to a part of the handgun parts.

FIG. 13*a* illustrates a circuit that can be used as an alternative to the IC 264 of FIG. 13 if only preventing firing of the handgun 260 based on receiving the signal and on the receiver 263 being restricted in the receiving of the signal is desired. It consists of a timer 261*a*, or capacitor 262*a*, three resistors 263*a*, 264*a* and 265*a*, an SCR 266*a*, an inverter 267*a*, a two input AND gate 268*a*, a receiver driver 270*a*, a transmitter driver 271*a*, and a solenoid driver 272*a*. The switch 265 is connected to the power input of the timer 261*a* and to an RC network formed by the capacitor 262*a* and two of the resistors 263*a*, 264*a*. The output of the transmitter driver 271*a* goes to the power input of the receiver 263, and the output of the transmitter driver 271*a* goes to the power input of the transmitter 267. The anode of the SCR 266*a* is connected to the switch 265 and its gate is connected to the output of the receiver 263. The output of the SWR sensor 262 is connected to one input of the AND gate 268*a*. The output of the solenoid driver 272*a* goes to the solenoid apart of the trigger blocking apparatus 268. The timer 261*a* can be an IC timer having two complementary outputs, logic 1 level triggering and the capability of being set to provide a time period having a length suitable for turning on the receiver 263 and obtaining a useful output. The RC network has a capacitance which permits triggering by the battery power being switched on and resistances which discharge the capacitor 262*a* quickly enough for the timer 261*a* to be triggered again and again during rapid firing. The SCR 266*a* must have the capability of being triggered by the output of the receiver 263, the resistor 265*a* connected to the SCR cathode has a value that allows for proper operation of the SCR 266*a* and inverter 267*a* and the transmitter 267 must be capable of being set to a frequency 1 kilohertz away from the frequency that the receiver 263 is tuned to and transmitting of signal modulated by a frequency based on a serial number assigned to the handgun 260. Closing the switch 265 for firing turns on and triggers the timer 261*a* which turns on the receiver 263 by way of the timer's normally off output and the receiver driver 270*a*. The reception of a signal by the receiver 263 results in the SCR 266*a* being triggered and a 1 level being applied to the inverter 267*a*. The output of the inverter 267*a* will then be a 0 level applied to one input of the gate 268*a* until the switch 265 is opened. If no signal is received, a 1 level will be applied to the gate 268*a* until the switch 265 is opened. After the timing period, the timer's output to the receiver driver 270*a* goes to the 0 level and its normally on output to the transmitter 267 driver goes to the 1 level. This turns on the transmitter driver 271*a* which turns on the transmitter 267. A signal is then transmitted by way of the SWR sensor 262. If the sensor 262 senses a normal SWR, a 1 level is applied to the remaining input of the AND gate 268*a*. If not, a 0 level is applied to the input, Only logic 1 levels on both of the gate's inputs turn on the solenoid driver 272*a* to energize the solenoid part of the trigger blocking apparatus 268 and allow firing.

The electronic parts of this handgun 260 together with the mechanical parts of the trigger blocking apparatus 268 can be regarded as an apparatus for reducing the criminal usefulness of a hand weapon (in this case the weapon formed by the remaining parts of the handgun 260) comprising a means for receiving a signal and a means for preventing the discharging of the weapon based on the receiving means receiving the signal and on the receiving means being restricted in receiving the signal.

It is possible to use a light or acoustic signal in a manner similar to the way a radio signal is used with this handgun 260.

It is also possible to use other parts to yield a different distance form an antifiring system that the handgun 260 may be fired within, however the parts chosen are good choices. They make the handgun 260 useless for robberies in protected locations while not affecting its use in other locations.

Figure 17:
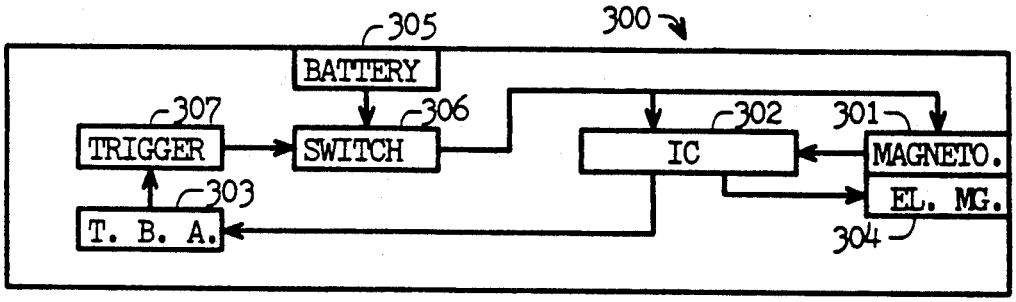
FIG. 17 is a block diagram of a handgun having electronic parts.
Figure 18:
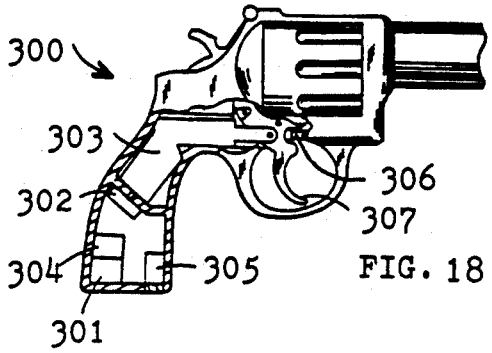
FIG. 18 further illustrates the handgun of FIG. 17.

FIGS. 17 and 18 illustrate a handgun 300 having a magnetometer 301 that senses the density of magnetic flux surrounding the handgun 300. It is located in the in the handle of the handgun 300 which is made of a nonferromagnetic material to prevent interference with magnetic sensing. The output of the magnetometer 301 goes an IC 302. The IC 302 has two outputs: one goes to a trigger blocking apparatus 303 and the other goes to an electromagnet 304 which is located close to the magnetometer 301. A battery 305 supplies power to a normally off switch 306 which is controlled by the trigger 307. The output of the switch 306 goes to the magnetometer 301 and IC 302.

Except for its electronic parts and the mechanical parts of its trigger blocking apparatus 303 the handgun 300 is essentially a revolver of conventional design.

Slightly pulling the trigger 307 for firing closes the switch 306 which sends power to the magnetometer 301 and the IC 302. This causes the magnetometer 301 to sense the magnetic flux density surrounding the handgun 300 and then send that information to the IC 302. The magnetic flux density produced by the earth is about 0.5 gauss and if the magnetometer 301 senses a normal magnetic flux density (less than 1 gauss), the IC 302 sends a pulse of power to the electromagnet 304. This is important for the handgun 300. It is done to determine whether or not the sensing ability of the magnetometer 301 is being restricted. The power causes the electromagnet 304 is produce a brief magnetic field of 1.5 gauss of the location of the magnetometer 301.

The magnetometer 301 senses the field and sends information about the field to the IC 302. Attempts to circumvent the handgun's operation by shielding or tampering with the magnetometer 301 is sensed as an abnormal flux density by the magnetometer 301 when the electromagnet 304 is energized.

If the magnetometer 301 output is normal, is normal, the IC 302 wills end power to the trigger blocking apparatus 303 which allows firing of the handgun 300. If the information is abnormal, no power will be sent to the trigger blocking apparatus 303 and the handgun 300 will not be able to be fired. This prevents a person from tapering with or shielding the magnetometer 301 to restrict the sensing of magnetic flux density. Thus, in order to be fired, the magnetic flux density surrounding the handgun 300 must not be more than 1 gauss and the magnetometer 301 must be unshielded and working properly.

Figure 17A:
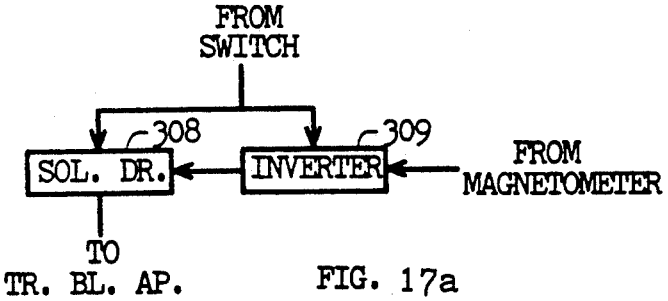
FIG. 17*a* illustrates an alternative to a part of the handgun of FIG. 17.

FIG. 17*a* illustrates a circuit that can be used as an alternative to the IC 302 of FIG. 13 if only preventing firing of the handgun 300 based on the magnetic flux density surrounding the handgun 300 based more than a certain amount is desired. If is based on am magnetometer having a 1 level output when it senses a magnetic flux density of more than 1 gauss. It consists of a solenoid driver 308 and an inverter 309. The power inputs of the solenoid driver 308 and inverter 309 are connected to the switch 306, the control input to the inverter 309 is connected to the magnetometer 301 and the output of the solenoid driver 308 is connected to the solenoid part of the trigger blocking apparatus 303. Closing the switch 306 for firing sends power to solenoid driver 308, inverter 309 and magnetometer 301. If the magnetometer 301 senses a magnetic flux density of more than 1 gauss, its logic 1 level output going to the inverter 309 results in a 0 output applied to the solenoid driver 308 which does not turn on the driver 308. If the magnetometer 301 does not sense a flux density of more than 1 gauss its output of a 0 level results in an inverter output 1 level which turns on the solenoid driver 308. This energizes the solenoid which allows firing.

The electronic parts of this handgun 300 together with the mechanical parts of the trigger blocking apparatus 303 can be regarded as an apparatus for reducing the criminal usefulness of a hand weapon (in this case the weapon formed by the remaining parts of the handgun 300) comprising a means for sensing magnetic flux density surrounding the weapon and means for preventing the discharging of the weapon based on the flux density being more than a certain amount.

The inability to fire this handgun 300 is locations having a magnetic flux density of more than 1 gauss makes it possible to place permanent magnets or electromagnets in locations susceptible to robberies so that this handgun 300 would be useless for robberies at those locations. This would only affect its operation at such locations and it could be used at all other locations without any limitations.

While the above description contains many specificities, these should not be constructed as limitations on the scope of the invention, but rather as exemplifications of the preferred embodiments thereof. Many variations are possible without departing from the scope of the invention as defined in the appended claims and their legal equivalents.

What is claimed is:

1. An apparatus comprising:

a dischargeable hand weapon;

means, connected to said weapon, for preventing the discharging of said weapon means for detecting a condition necessary for using said weapon for a use which involves the moving of said weapon;

first determining means, connected to said detecting means, for determining the existence of a requirement where more than one hour has past since said detecting means detected said condition;

second determining means, connected to said detecting means and to said first determining means, for determining the existence of a second requirement where less than thirty minutes has past since said detecting means detected said condition while said first determining means was determining the existence of said first requirement; and means, connected to said second determining means and to said preventing means for disabling said preventing means, and thereby allowing the discharging of said weapon, when said second determining means is determining the existence of said second requirement.

2. The apparatus of claim 1 wherein said detecting means comprises means for detecting movement of said weapon and said condition is one movement of said weapon detectable by said detecting means.

3. The apparatus of claim 1 further comprising:

means, enclosing a part of said apparatus that can be tampered with in order to circumvent the operation of said apparatus, for preventing access to said part unless damage is caused to said apparatus.

4. The apparatus of claim 1 further comprising:

lockable and unlockable means, enclosing a part of said apparatus that can be tampered with in order to circumvent the operation of said apparatus, for preventing, when said lockable and unlockable means is locked, access to said part unless damage is caused to said apparatus.

* * * * *